US008813970B2

(12) United States Patent
Jones

(10) Patent No.: US 8,813,970 B2
(45) Date of Patent: Aug. 26, 2014

(54) FILTER SCREEN WITH TENSION ELEMENT

(75) Inventor: Bradley Jones, Crestview Hills, KY (US)

(73) Assignee: M-I L.L.C., Houston, TX (US)

( * ) Notice: Subject to any disclaimer, the term of this patent is extended or adjusted under 35 U.S.C. 154(b) by 403 days.

(21) Appl. No.: 13/051,401

(22) Filed: Mar. 18, 2011

(65) Prior Publication Data

US 2011/0226677 A1 Sep. 22, 2011

Related U.S. Application Data

(60) Provisional application No. 61/315,556, filed on Mar. 19, 2010.

(51) Int. Cl.
*B07B 1/49* (2006.01)

(52) U.S. Cl.
USPC ..... 209/408; 209/233; 209/308; 209/397; 209/400

(58) Field of Classification Search
USPC ..... 209/233, 308, 397, 400, 401, 408, 395, 209/399, 403, 405
See application file for complete search history.

(56) References Cited

U.S. PATENT DOCUMENTS

| | | | | |
|---|---|---|---|---|
| 6,269,953 | B1 * | 8/2001 | Seyffert et al. | 209/399 |
| 7,216,768 | B2 * | 5/2007 | Fisher et al. | 209/395 |
| 7,980,392 | B2 * | 7/2011 | Larson et al. | 209/392 |
| 2003/0010437 | A1 * | 1/2003 | Adams et al. | 156/291 |
| 2007/0125687 | A1 * | 6/2007 | Kutryk | 209/397 |
| 2008/0078703 | A1 * | 4/2008 | Robertson | 209/397 |
| 2008/0245707 | A1 * | 10/2008 | Smith | 209/412 |
| 2011/0120920 | A1 * | 5/2011 | Smith | 209/397 |
| 2012/0125823 | A1 * | 5/2012 | Smith | 209/363 |

FOREIGN PATENT DOCUMENTS

CN 201613225 U 10/2010

OTHER PUBLICATIONS

Search Report issued in corresponding British Patent Application No. GB1104750.3; Dated May 26, 2011 (4 pages).
Examination Report issued in corresponding British Application No. GB1104750.3; Dated Mar. 12, 2013 (2 pages).

* cited by examiner

*Primary Examiner* — Terrell Matthews
(74) *Attorney, Agent, or Firm* — Osha Liang LLP

(57) ABSTRACT

A filter screen including a frame having an upstream surface, a downstream surface opposite the upstream surface, a perimeter grating element, and a plurality of inner grating elements extending within the perimeter grating element and forming at least one opening extending from the upstream surface to the downstream surface; a filter element disposed on the upstream surface; and a tension element disposed on the downstream surface. A method of manufacturing a filter screen, the method including forming a frame having an upstream surface, a downstream surface opposite the upstream surface, a perimeter grating element, and a plurality of inner grating elements extending within the perimeter grating element and forming at least one opening extending from the upstream surface to the downstream surface; attaching a filter element to the upstream surface; and attaching a tension element to the downstream surface.

19 Claims, 6 Drawing Sheets

FILTER SCREEN WITH TENSION ELEMENT

BACKGROUND OF INVENTION

1. Field of the Invention

Embodiments disclosed herein relate generally to filter screens. Particularly, embodiments disclosed herein relate to filter screens used in vibrating separators for wet or dry applications.

2. Background Art

Vibratory separators have long been used for the separation of both dry and wet materials, and are used in industries as varied as the chemical, food and beverage, powder coating, pharmaceutical, plastic, pulp and paper, ceramic, oilfield, and laundry industries. Vibratory separators, as used herein, generally refer to any type of separator or sifter used in the industrial processing of materials. Examples of materials and applications of industrial separators include metal powder, flour, sugar grinding, salt, steel shot, meat meal, sugar scalping, plastics, resin, fertilizer, petroleum coke, pharmaceuticals, wheat, soybean and oilseed, pellets and crumbles, and clay. Such separators may be circular or rectangular in cross section, and may include a vibration-generating device and resiliently mounted housings. Filter screens are fixed to the vibratory housings such that material fed to the vibrating filter screens may be screened. Various vibratory motions may be employed to work the material on the screen in the most advantageous manner. Frequently, discharge openings are provided both above the screening mechanism and below for retrieving the separated materials.

Some factors for selecting a particular vibratory separator include general material information, material characteristics, wet material data, material safety information, separator efficiency requirements, and desired use for the vibratory separator. For example, general material information may include the material to be screened, the temperature of the material, bulk density, specific gravity, and particle shape (spherical, fibrous, platelet, etc.). Materials may be characterized as granular, powder, abrasive, electrostatic, sticky, corrosive, free flowing, and agglomerates, among other characterizations. Key wet material data may include whether the material is viscous, greasy/oily, thixotropic, paste-like, sticky, or fatty. Furthermore, standard process data such as feed rate and minimum/maximum percentage of solids are important factors for selection of a vibratory separator. MSDS information, including numbers representing the severity of health, flammability and reactivity may be important depending on industry and application. Efficiency requirements vary by industry and application and are also important factors. Finally, those of ordinary skill in the art will appreciate that a vibratory separator may be used to scalp, dedust, or dewater, among other alternative uses.

In operation, a vibratory separator may be actuated to provide a flow of materials through the vibratory separator, such that solid particles are divided according to relative size. Thus, as the materials flow over a screen, larger particles exit the vibratory separator through a discharge outlet, while smaller particles exit through a secondary discharge area. The screen may include one or more filtering elements that may be manufactured from metals, plastics, cloth, and/or composites. Screens may be selected based on mesh size or micron size, among other sizing selection alternatives.

Over time, screens may be exposed to erosive and/or corrosive substances and operational conditions that degrade the screen effectiveness or efficiency of the filtering elements. Examples of operational conditions that may cause such an effect include typical actuation of the vibratory separator to impart movement in vertical and lateral directions. Over time, the vibratory motion, for example, in the vertical direction, may decrease the integrity of the screens due to structural damage, filtering element loosening, and the like. Such decreases in integrity may manifest as a slackening of the screen or parting of the screen from the frame, frame warpage or failure, or failure of the filtering element at the intersection with the frame. Further, screen failure may result from a broken screen, a screen tear, or bypass around a screen from improper sealing.

Screen failure may result in oversized particles entering the discharge underflow line of a vibratory separator. In wet screening of certain products, a maximum particle size may be important to manufacturing processes, and failure to screen to such a maximum size may lead to a large amount of final product being rejected or having to be reworked at a significant expense.

Accordingly, there exists a need for high strength filter screens for use in the separation of dry and wet materials.

SUMMARY OF INVENTION

In one aspect, the embodiments disclosed herein relate to a filter screen including a frame having an upstream surface, a downstream surface opposite the upstream surface, a perimeter grating element, and a plurality of inner grating elements extending within the perimeter grating element and forming at least one opening extending from the upstream surface to the downstream surface; a filter element disposed on the upstream surface; and a tension element disposed on the downstream surface.

In another aspect, the embodiments disclosed herein relate to a method of manufacturing a filter screen, the method including forming a frame having an upstream surface, a downstream surface opposite the upstream surface, a perimeter grating element, and a plurality of inner grating elements extending within the perimeter grating element and forming at least one opening extending from the upstream surface to the downstream surface; attaching a filter element to the upstream surface; and attaching a tension element to the downstream surface.

Other aspects and advantages of the invention will be apparent from the following description and the appended claims.

DETAILED DESCRIPTION

In one aspect, embodiments disclosed herein relate to a filter screen. More specifically, embodiments disclosed herein relate to filter screens having a tension element on a downstream surface.

Figure 1:
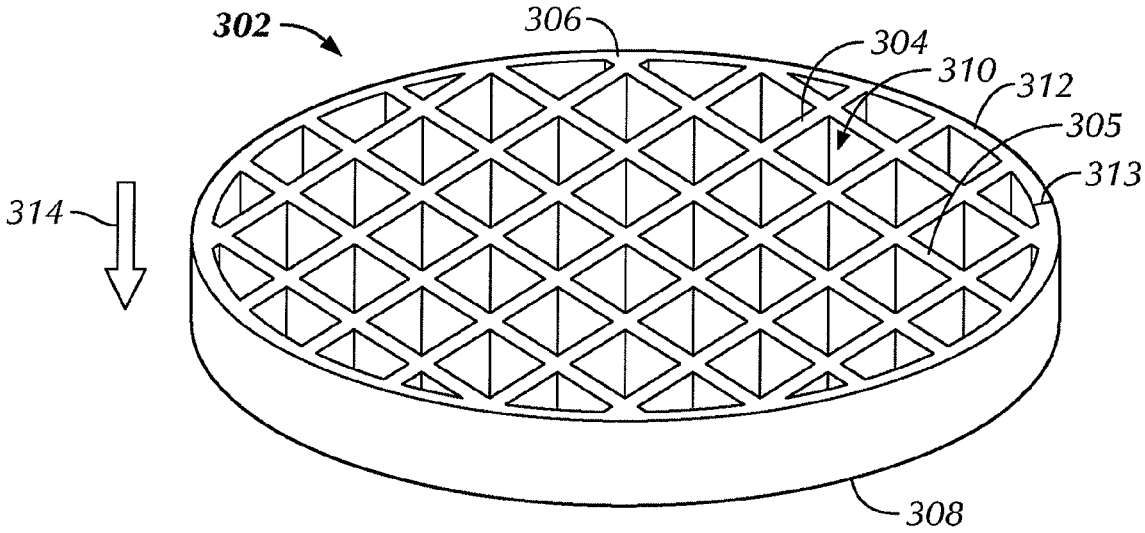
FIG. 1 is a perspective view of a round frame in accordance with an embodiment of the present disclosure.

FIG. 1 shows a round frame 302 formed from a plurality of inner grating elements 304 surrounded by a perimeter grating element 312. The grating elements 304 and 312 may additionally be described as grating ribs. An arrow 314 shows the direction a processed material moves through the frame 302. The frame 302 has an upstream surface 306 and a downstream surface 308. The upstream and downstream surfaces 306 and 308 are defined by the surface area of the grating elements 304 and 312 that face in the upstream and downstream directions.

The grating elements 304 and 312 may be configured to provide support and structure to the frame 302 for separating materials. The grating elements 304 and 312 may additionally be configured to support the filter element (not shown) and tension element (not shown) discussed in detail below. The surface area of grating elements 304 and 312 may be minimized in order to maximize the screening area and allow more material to pass through the filter screen. Minimizing the surface area may be accomplished by reducing the width 305 and 313 of the grating elements 304 and 312, changing the layout of the inner grating elements 304, or reducing the number of inner grating elements 304. Openings 310, or cells, are located between the grating elements 304 and 312. Therefore, when the upstream and downstream surface area of the grating elements 304 and 312 is minimized, the area of the openings 310 is increased. It may be advantageous to create more open area in order to increase the flow rate of the processed material. However, the overall strength of a frame may be reduced by decreasing the surface area of the grating elements.

The inner grating elements 304 shown in FIG. 1 have a rectangular or square layout, and the perimeter grating element 312 has a round or circular layout. In general, round or circular frames are one foot to six feet in diameter based on the requirements of the machines in which the filter screens are used. Additionally, the openings 310 may be ½ inch to six inches wide and ½ inch to six inches deep. The openings 310 may be equal or different sizes. Many factors may determine the size of the openings 310, such as material to be processed, particle sizes in the processed material, the overall size of the frame 302, the required rigidity and strength of the frame 302, and the required support structure for a filter element (not shown) and a tension element (not shown). Those of ordinary skill in the art will appreciate that larger and smaller frames may be manufactured with larger or smaller openings 310.

Figure 2:
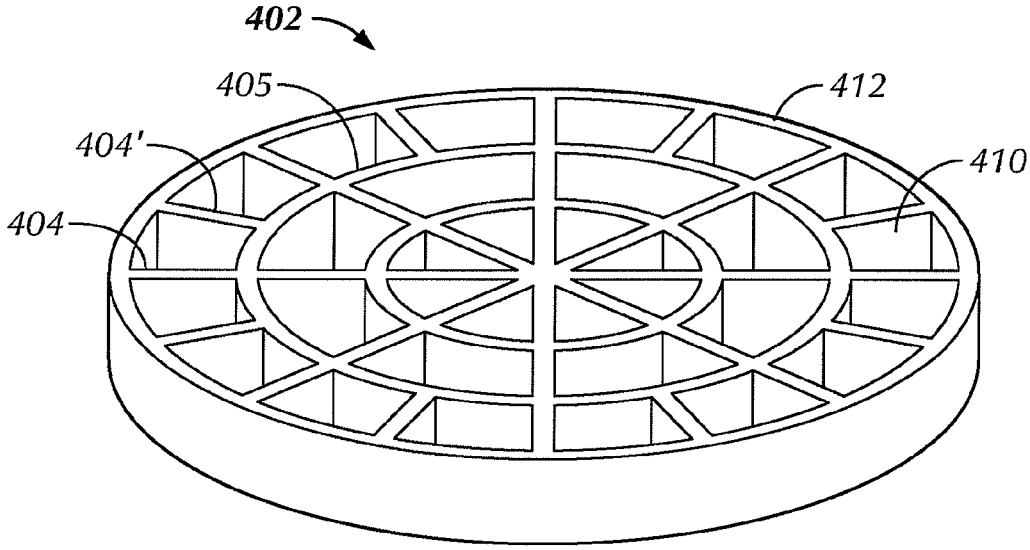
FIG. 2 is a perspective view of a round frame in accordance with an embodiment of the present disclosure.

FIG. 2 shows an alternative embodiment of a round frame 402. The inner grating elements 404 of the frame 402 have a radial pattern, consisting of inner grating elements 404 extending from a central location to a perimeter grating element 412. Some inner grating elements 404' may not extend the full radial length. Concentric grating elements 405 may further divide the openings 410.

Referring generally to FIGS. 1 and 2, those of ordinary skill in the art will appreciate that inner grating elements may be formed in a variety of layouts. The cells may be triangular, rectangular, hexagonal, or irregular in shape. Some layouts of inner grating elements may be better for particular shapes and/or sizes of perimeter grating elements. Some layouts may provide structural benefits, such as increased rigidity.

Figure 3:
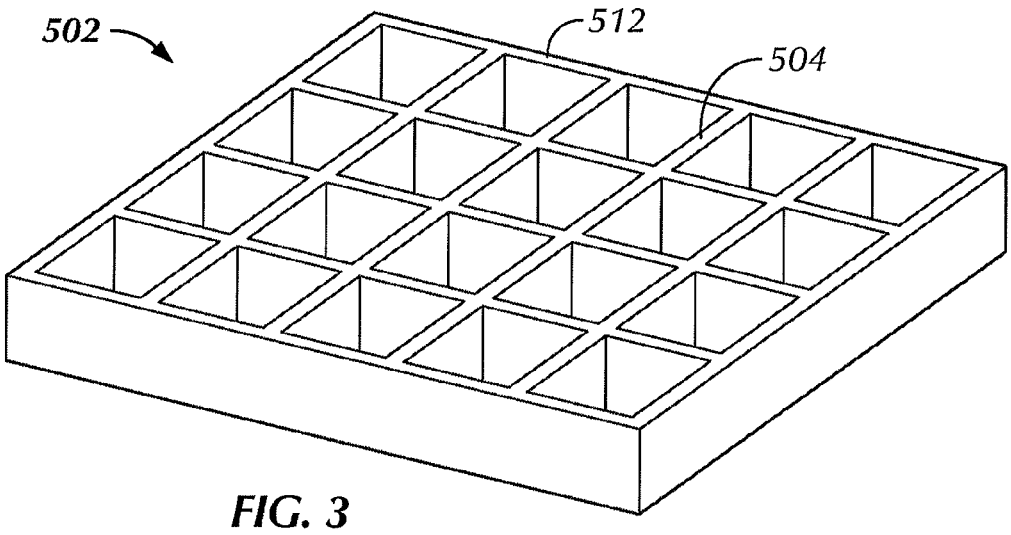
FIG. 3 is a perspective view of a rectangular frame in accordance with an embodiment of the present disclosure.

FIG. 3 shows a rectangular frame 502. The perimeter grating element 512 forms a rectangular shape. The inner grating elements 504 of the frame 502 have a rectangular or square layout. The size and shape of the perimeter grating element 512 is generally determined based on the size and shape of the mounting location of the machine, e.g., a separator or shaker. Thus, the frame 502 may be geometric or irregular in shape. The frame 502 may additionally vary in size. The frame 502 may have an area in the range of one square foot to thirty square feet, where area describes the overall size of the frame 502 and not just the surface area.

Figure 4:
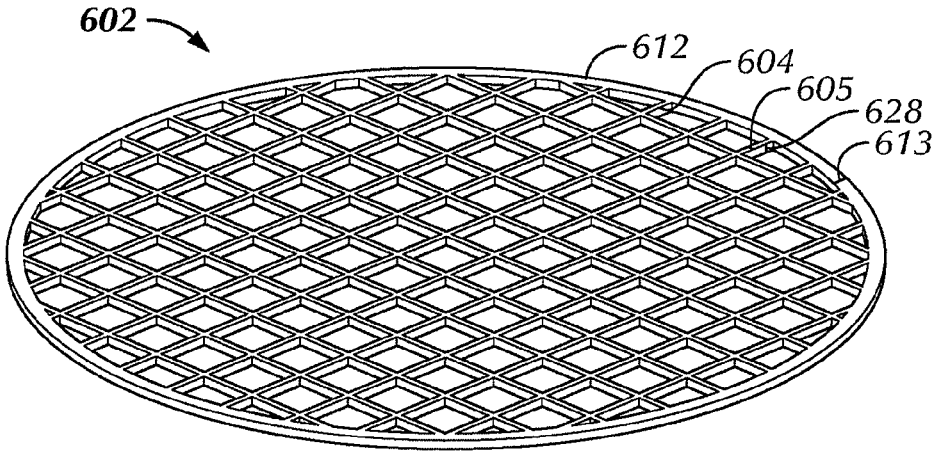
FIG. 4 is a perspective view of a round frame in accordance with an embodiment of the present disclosure.

FIGS. 1 through 3 show frames 302, 402, and 502 having a perimeter grating element 312, 412, and 512, respectively, substantially the same width as the inner grating elements 304, 404, and 504. In one embodiment shown in FIG. 4, a frame 602 has a perimeter grating element 612 that is substantially wider than the interior grating elements 604. The wider perimeter grating element 612 may provide more rigidity and/or strength to the frame 602. Additionally, the increased width 613 may provide more surface area to attach a tension element (not shown) or a filter element (not shown). The increased width 613 may also assist in mounting the filter screen in the machine. Those of ordinary skill in the art will appreciate that the perimeter grating elements and inner grating elements may have non uniform dimensions within the same frame. For example, inner grating elements and/or perimeter grating elements that extend greater distances, e.g., in the longest direction of a rectangular shaped frame, may have greater width or height. Additionally, those of ordinary skill in the art will appreciate that while dimensions are described in terms of width and height, the inner grating elements and perimeter grating elements may have a cross-section other than rectangular shaped.

Figure 5:
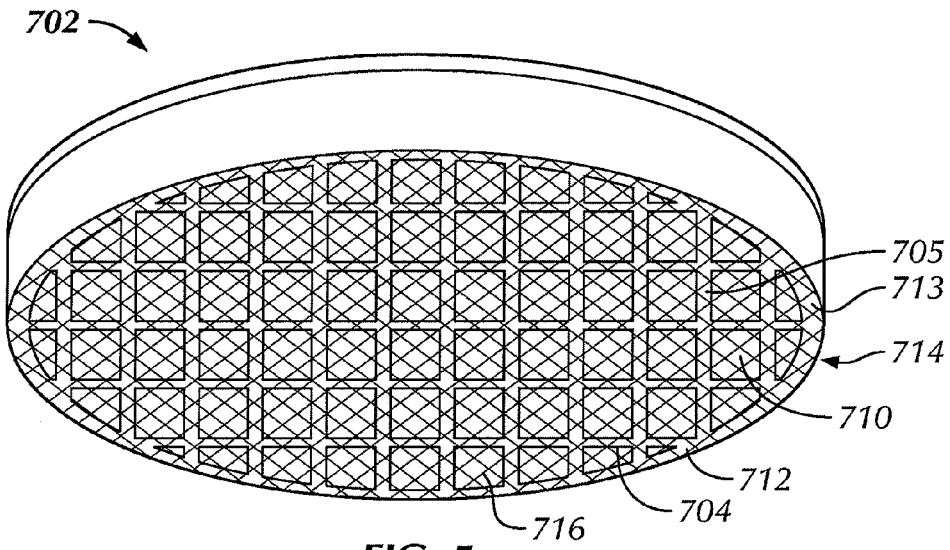
FIG. 5 is a perspective view of a screen frame in accordance with an embodiment of the present disclosure.

FIG. 5 depicts a tension element 714 located on the downstream surface 708 of a frame 702 in accordance with embodiments of the present disclosure. The frame 702 is round, i.e. has a round perimeter grating element 712, with the inner grating elements 704 forming substantially rectangular or square openings 710. The tension element 714 attaches to the perimeter grating element 712. Specifically, the tension element 714 may attach to the downstream surface 713 of the perimeter grating element 712. The tension element 714 may additionally attach to the downstream surface 705 of the inner grating elements 704.

FIG. 5 shows a tension element 714 that includes tension members 716. The tension member 716 may be a cable, cord, wire, line, rod, filament, fiber, or other known lengths of material. The tension element 714 may be formed by an interweaving or meshing of any one or combination of these materials. Alternatively, tension element 714 may be formed from expanded metal or a perforated plate. The tension element 714 is attached to the frame 702, and when the frame 702 attempts to bend or flex in the upstream or downstream direction, the tension element 714 stretches in tension. The tension element 714 resists the tensile stresses and minimizes bending of the frame 702. The tension element 714 may pull or bias the frame 702 inward toward an approximately central location of the tension element 714. The filter element (not shown) may act in a similar way on the upstream surface (not shown). When the frame 702 bends or flexes in the upstream and downstream directions, the filter element (not shown) resists the tensile stresses and minimizes bending of the frame 702.

Figure 6:
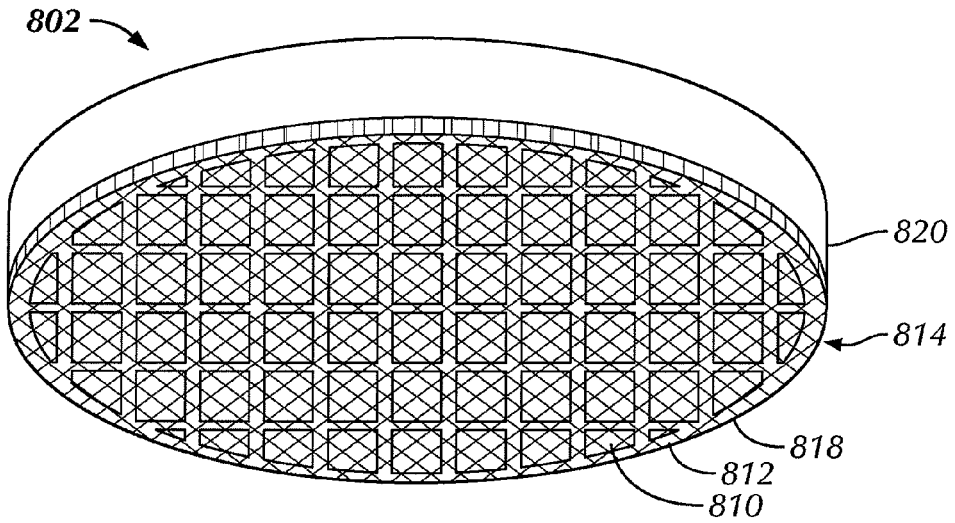
FIG. 6 is a perspective view of a screen frame in accordance with an embodiment of the present disclosure.

FIG. 6 depicts a tension element 814 located on the downstream surface 808 and perimeter surface of a frame 802 in accordance with an embodiment of the present disclosure. The frame 802 is round with the grating elements 804 forming substantially rectangular or square openings 810. The tension element 814 extends around the edge 818 of the perimeter grating element 812 and attaches to the perimeter surface 820. Tension in the tension element 814 may pull on the perimeter surface 820 and pull the frame 802 inward.

The tension element 814 biases the perimeter grating element 821 radially inwards whether the tension element 814 extends around the edge 818 to attach to the perimeter surface 820 or the tension element attaches only to the downstream surface 812. The overall force of the tension element 814 may pull the frame surfaces towards a substantially central location, a location within the area of frame 802. The amount of tension in the tension element 814 may be within a range of 0.1 to 95 percent of the yield strength of the tension element 814. The amount of tension selected may be based on the amount of tension which prevents substantial movement and flexure of the tension element 814 perpendicular to the downstream surface 812, particularly within the dimensions of the openings 810 of the frame 802. The actual amount of tension may be dependent on the type of tension element 814 and the material from which the tension element 814 is formed. For example, a perforated plate may have less tension compared to a woven mesh. Specifically, the amount of tension in a perforated plate may be almost zero, whereas the amount of tension in a woven mesh may be 10 percent of material yield strength.

Figure 7A:
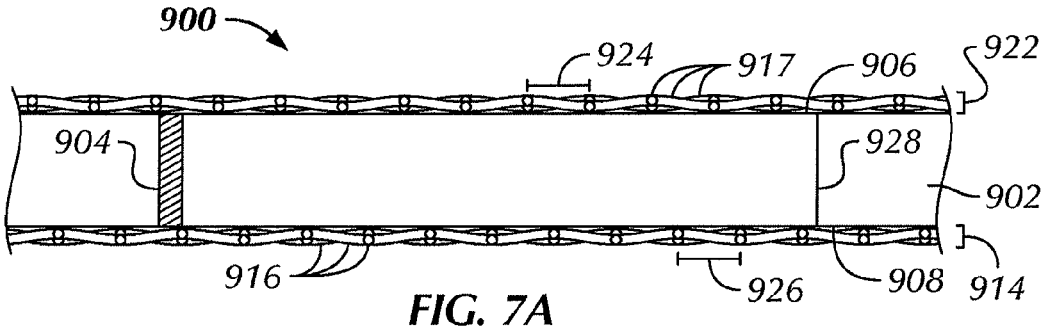
FIG. 7A is a cross-sectional view of a screen frame in accordance with an embodiment of the present disclosure.

FIG. 7A shows a cross section of a filter screen 900 having a frame 902, a filter element 922, and a tension element 914 in accordance with an embodiment of the present disclosure. The frame includes an inner grating element 904. The filter element 922 is shown as a woven mesh on the upstream surface 906 of the frame 902. The tension element 914 is shown as a woven mesh on the downstream surface 908. The tension element 914 includes openings 926 that are larger than openings 924 in the filter element 922, thereby assuring that substantially all material that passes through the filter element 922 may also pass through the tension element 914. In some embodiments, the openings 926 in the tension element 914 may be fifteen to one hundred times larger than the openings 924 in the filter element. Those of ordinary skill in the art will appreciate that while the openings 926 are shown as substantially square, any geometric or irregular shaped opening 926 may be used.

The filter element 922 may be bonded to upstream surface 906 of the frame 902. Additionally, the tension element 914 may be bonded to the downstream surface 908 of the frame 902. Bonding may include heat staking, ultrasonic welding, and thermal bonding.

Alternatively, the filter element and/or tension element may be fastened to the frame using mechanical fasteners. Those of ordinary skill in the art will appreciate that mechanical fasteners may include clamps, brackets, screws, bolts, or any other mechanical device that may mechanically fix the filter element 922 and/or the tension element 914 to the frame 902. An alternative embodiment may use adhesives to attach the tension element 914 and/or the filter element 922 to the frame 902.

The filter screen 900 includes both the tension element 914 and the filter element 922 that may act as structural elements, i.e., the tension element 914 and/or the filter element 922 may contribute to the strength, stiffness, damping, or other structural properties, of the filter screen 900. Both the tension element 914 and the filter element 922 may provide tension that gives the filter screen 900 increased rigidity even under high loads and aggressive vibration. The tension stored in the tension element 714 and the filter element 922 may reduce flexing of the frame 902 during use. When the frame 902 flexes in such a way to cause the tension element 914 or the filter element 922 to stretch, the resulting increase in tension counteracts the flexing. Because the tension element 914 and filter element 922 are on opposing surfaces of the frame 902, the forces from the tension element 914 and the filter element 920 counteract both the flexing and each other to create a stiff filter screen 900.

The height 928 of the frame 902 may be an important factor in determining the beam stiffness of the filter screen 900. The beam stiffness is dependent on the second moment of inertia, I, and Young's modulus, E. The tension element 914 and the filter element 922 act on opposing surfaces of the filter screen 900. The second moment of inertia, I, for the filter screen 900 may be approximated using a simplified model for a sandwich type composite body. Therefore, increasing the height 928 of the frame 902 may additionally increase the second moment of inertia and ultimately the beam stiffness. However, those of ordinary skill in the art will appreciate that the upper limit of the height 928 is limited by the machines in which the filter screens 900 are used, so the filter screen 900 may fit within the machine. Currently, in conventional vibratory separators the upper limit of the height 928 is about two and a half inches. With respect to a lower limit, too small of a height 928 may lower the second moment of inertia and limit the effectiveness of the tension element 914 and filter element 922 to provide sufficient rigidity and strength over a sufficient filter screen area. Thus, the height of the screen may be in a range between about ¼ inch to 2½ inches.

Figure 7B:
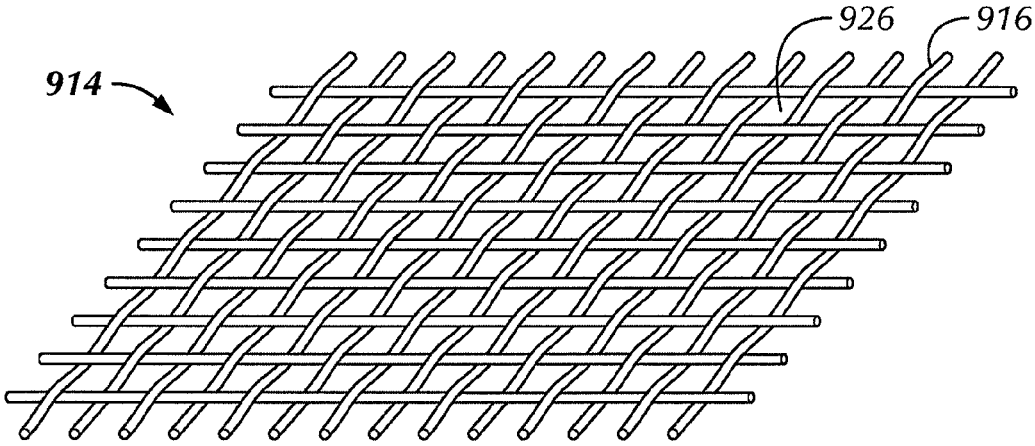
FIG. 7B is a perspective view of a tension element in accordance with an embodiment of the present disclosure.

A woven mesh type of tension element 914, as shown in FIGS. 7A and 7B, includes tension members 916 that are intertwined. The woven mesh may be similar to a woven fabric or cloth composed of interwoven fibers. Thus, with respect to manufacturing, a piece of mesh may be cut to size and bonded to the frame 902. Advantageously, manufacturing the filter screen 900 may be quick and relatively simple. With respect to the use of the filter screen 900, using a tension element 914 in the form of a mesh would ensure structural integrity even if some tension members 916 fail during use.

The filter element 922 may be formed from filtering members 917. The filtering members 917 that form the filter element 922 may be similar to the tension members 916 that form the tension element 914. The filtering members 917 may include fibers, cables, cords, wires, lines, rods, filaments, or other known strands of material. The filtering members 917 may be interwoven and form a mesh. The filtering members 917 may differ from the tension members 916 in that the filtering members 917 may be finer, or have a smaller cross-sectional area than the tension members 916. Additionally, there may be a higher number of filtering members 917 in the filter element 922 compared to the number of tension members 916 in the tension element 914.

The cross-sectional area and quantity of the tension members 916 and filtering members 917 may affect the amount of tension in the tension element 914 and the filter element 922, respectively. In one embodiment, the individual tension members 916 of the tension element 914 have a larger cross-sectional area than the individual filtering members 917. The greater quantity of filtering members 917 that form the filter element 922 may compensate for the smaller cross-section of the filtering members 917 to create substantially the same tension as the collective tension members 916 in the tension element 922. Alternatively, tension element 914 and filter element 922 may have different tension. Those of ordinary skill in the art will appreciated that filter elements 922 and tension elements 914 having alternative forms than described above, e.g., expanded metal and perforated sheets, may be used and may have similar tension properties based on material and cross-sectional area without departing from the scope of embodiments disclosed herein.

Figure 8A:
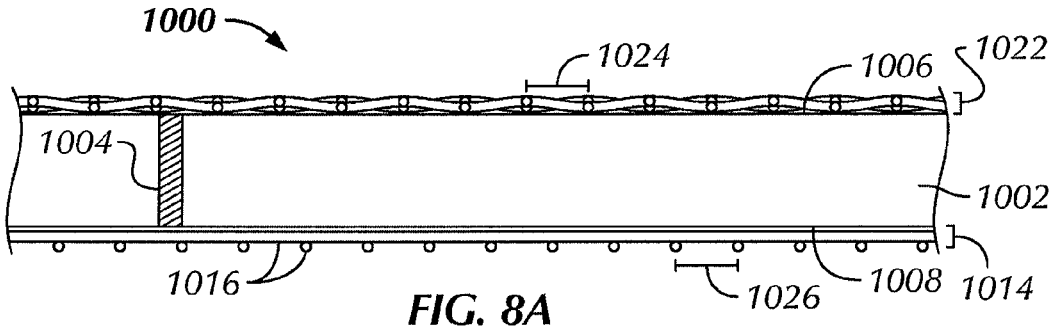
FIG. 8A is a cross-sectional view of a screen frame in accordance with an embodiment of the present disclosure.
Figure 8B:
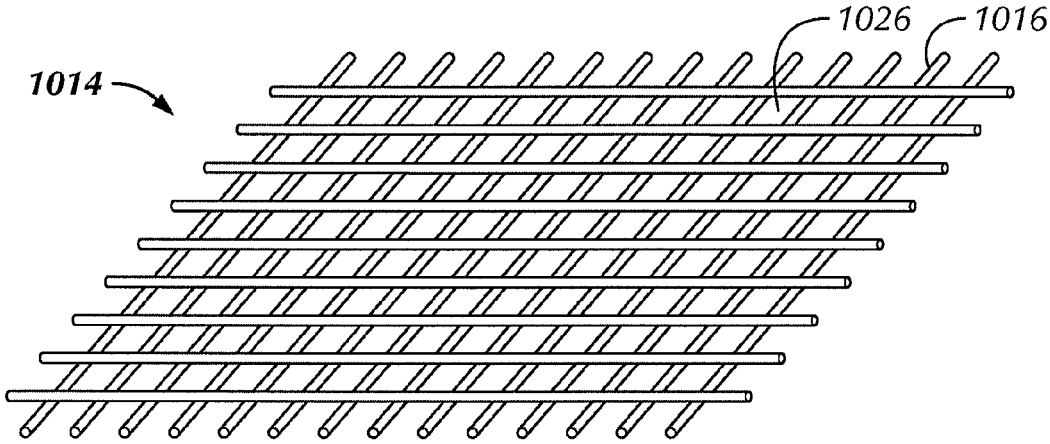
FIG. 8B is a perspective view of a tension element in accordance with an embodiment of the present disclosure.

FIGS. 8A and 8B show a filter screen 1000 having a woven mesh filter element 1022 on the upstream surface 1006 of the frame 1002, including the inner grating elements 1004, and a tension element 1014 on the downstream surface 1008 in accordance with an embodiment of the present disclosure. The tension element 1014 includes tension members 1016 similar to the embodiment shown in FIGS. 7A and 7B. However, in the embodiment shown in FIGS. 8A and 8B, the tension element 1014 is formed from a plurality of tension members 1016 that do not form a woven pattern. Although the tension members 1016 are shown in a perpendicular grid creating substantially square openings 1026, those of ordinary skill in the art will appreciate that the tension members 1016 of a tension element 1014 may form any pattern that biases the perimeter grating element (not shown) inwards. For example, two layers of tension members 1016 may be angled, creating a rhombus-shaped opening. Additionally, a third layer may be added to create a triangular shaped opening.

In one embodiment, openings 1026 in the tension element 1014 are larger than the openings 1024 in the filter element 1022. Larger openings 1026 in the tension element 1014 may allow all material that passed through the filter element 1022 to pass through the tension element 1014. A radial arrangement (Not shown) of tension members 1016, similar to spokes on a wheel, may be used. However, depending on the number of tension members 1016 in the central region of the tension element 1014, the converging tension members 1016 may form an opening 1026 too small or thin for the processed material to pass through. An obstructed opening 1026 in the tension element 1014 may restrict the flow of material that was able to pass through the filter element 1014. The openings 1010 of the frame 1002 may additionally become obstructed and reduce the flow rate of processed material.

Figure 9A:
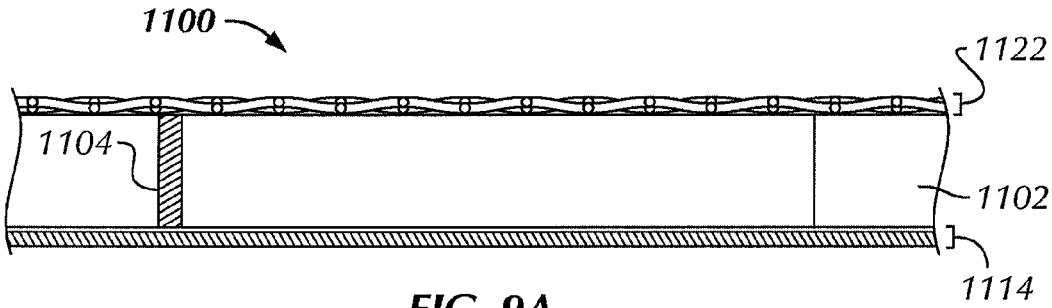
FIG. 9A is a cross-sectional view of a screen frame in accordance with an embodiment of the present disclosure.
Figure 9B:
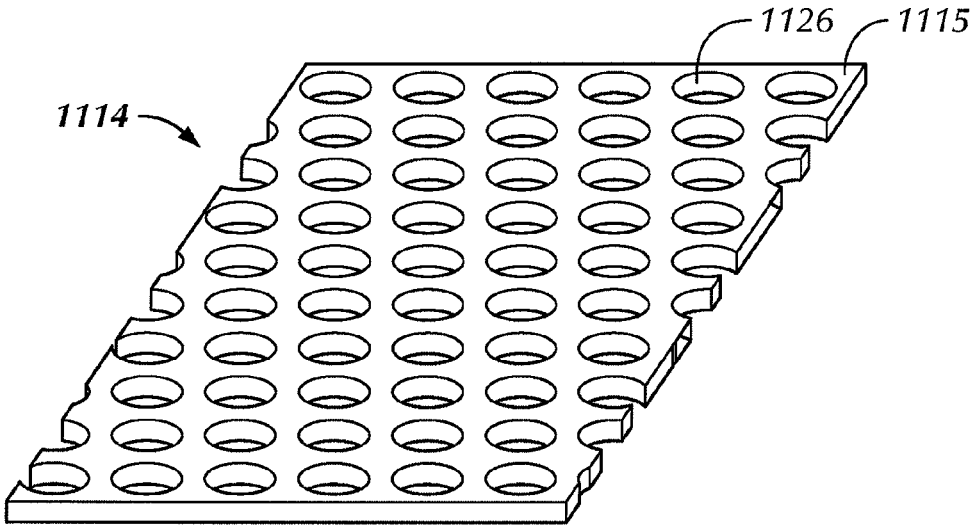
FIG. 9B is a perspective view of a tension element in accordance with an embodiment of the present disclosure.

FIGS. 9A and 9B show one embodiment of a filter screen 1100 having a tension element 1114 formed from a perforated plate 1115 in accordance with an embodiment of the present disclosure. The plate may be metal or composite. The tension element 1114 may have a Young's modulus, E, that is greater than the frame 1102 material, including inner grating element 1104. The tensile strength of the tension element 1114 may also be sufficient to prevent plastic deformation and ultimate failure. The openings 1126 in the perforated plate are larger than the openings in the filter element 1122. In one embodiment, the tension element 1114 is formed from expanded metal. Expanded metal may have diamond shaped openings 1126 that form as a result of stretching the metal after cuts have been made in the stock metal sheet.

The tension in the tension element 1114 may change while the filter screen 1100 is in use. The vibration and or loads applied by the material may cause the filter screen 1100 to bend. The bending may cause the tension in the tension element 1100 to increase and or decrease. The amount of tension, and response to the change in tension, may be adjusted by changing the material and/or cross-sectional area of the tension element 1114. Additionally, the sizes, shapes, and locations of the openings 1126 in the perforated plate may impact the tension.

Referring generally to FIGS. 1-9, balls may be located within the openings of the frame, between the filter element and the tension element. The balls may be formed from an elastomer, or rubber. During vibration of the filter screen, the balls vibrate or hammer on the filter screen to reduce clogging, plugging, or blinding of the filtering element. This arrangement may be referred to as a deblinding kit, as the hammering of the balls provides a mechanism to reduce the blinding of the openings.

The frame may be formed from a polymer, specifically a thermoplastic with or without additives. One thermoplastic that may be used is polypropylene. Thermoplastics are relatively lightweight. Thermoplastics may be formed quickly and with little cost per unit. Additionally, the properties of thermoplastics may provide a surface that is easily bonded or attached to other elements, including elements formed from other materials. Those of ordinary skill in the art will appreciate that other materials, including a combination of two or more materials, may be used to form the frame. Examples of other materials include, but are not limited to, thermoset polymers and aluminum. The filter element and tension element may be attached to the screen frame with adhesives or mechanical fasteners known in the art.

A thermoplastic frame may be used in accordance with embodiments disclosed herein. A thermoplastic frame alone may lack the rigidity needed to be used in a vibratory shaker. Additionally, a thermoplastic frame alone may lack the strength to withstand the loads applied by the material being filtered. The tension element on the downstream surface in combination with the filter element on the upstream surface as disclosed herein may provide the strength and rigidity that the thermoplastic frame lacks alone. Thus, the frame may be relatively simple in design, not requiring internal or external reinforcement.

The tension element and filter element may be formed from stainless steel, which has suitable corrosion resistance, strength, and elongation properties. Stainless steel has high strength with little elongation. Thus, the tension element and filter element may provide adequate tension to the filter screen without failure, even when the filter screen is used in a corrosive environment. Those of ordinary skill in the art will appreciate that alternative materials may be used such as, for example, carbon fiber, aluminum, and steel.

The filter element may be a woven mesh with smaller openings than the tension element and frame. The filtered particulate matter may be removed from the rest of the processed material as the process material moves through the filter element. Embodiments disclosed herein may provide a tension element that acts as a safety screen on the downstream surface, i.e., any large particulate matter that passes through the filtered element, perhaps through a hole or tear in the filter element, may be stopped by the tension element.

Referring generally still to FIGS. 1-9, the filter screen may be manufactured by forming the frame, attaching the filter element to the upstream surface of the frame, and attaching a tension element to the downstream surface of the frame. The tension element may be attached to the perimeter grating element, including the perimeter surface. The tension element pulls on the frame, so that a net force of the tension element acting on the frame, results in the tension element biasing the frame inwards. The net force of the tension element may bias the grating elements of the frame towards a point approximately along a central axis.

The frame may be formed by injecting a polymer into a mold or extruding a polymer through a mold. The filter element and/or the tension element may be attached to the frame through a form of bonding, such as heat staking, ultrasonic welding, and thermal bonding. Alternatively, the filter element and/or the tension element may be attached to the frame through mechanical fasteners or adhesives.

Advantageously, embodiments disclosed herein provide a filter screen that may have increased strength and rigidity with less weight and complexity than filter screens already known in the art. A polymer frame is less expensive to produce than a composite frame having metal supports within the polymer exterior. Additionally, embodiments disclosed herein do not require additional reinforcement that may add weight, cost, and vulnerabilities to failure. Embodiments disclosed herein provide a filter screen that may be easier to install. Other advantages may include the tension element acting as a safety screen to stop large particles that may pass through the filter element. Additionally, embodiments disclosed may include elastomer balls to reduce or prevent blinding of the filtering element.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A filter screen comprising:
a frame comprising:
an upstream surface;
a downstream surface opposite the upstream surface;
a perimeter grating element; and
a plurality of inner grating elements extending within the perimeter grating element and forming at least one opening extending from the upstream surface to the downstream surface;
a filter element disposed on the upstream surface; and
a tension element disposed on the downstream surface.

2. The filter screen of claim 1, wherein the tension element is attached to the perimeter grating element.

3. The filter screen of claim 1, wherein a net force of the tension element biases the perimeter grating element inwards.

4. The filter screen of claim 1, wherein the frame comprises a polymer.

5. The filter screen of claim 1, wherein a modulus of elasticity of the tension element is greater than a modulus of elasticity of the frame.

6. The filter screen of claim 1, wherein at least one of the tension element and the filter element is a woven mesh.

7. The filter screen of claim 1, wherein at least one of the tension element and the filter element is attached to the frame by bonding, wherein the bonding is one selected from a group consisting of heat staking, ultrasonic welding, and thermal bonding.

8. The filter screen of claim 1, wherein at least one of the tension element and the filter element is attached to the frame with at least one mechanical fastener.

9. The filter screen of claim 1, wherein the frame is formed by one of a group consisting of injection molding and extrusion.

10. A method comprising:
forming a frame comprising:
an upstream surface;
a downstream surface opposite the upstream surface;
a perimeter grating element; and
a plurality of inner grating elements extending within the perimeter grating element and forming at least one opening extending from the upstream surface to the downstream surface;
attaching a filter element to the upstream surface; and
attaching a tension element to the downstream surface.

11. The method of claim 10, wherein attaching the tension element to the downstream surface comprises attaching the tension element to the perimeter grating element.

12. The method of claim 10, further comprising biasing the perimeter grating element to a substantially central point disposed on the downstream surface, wherein biasing is a result of a net force of the tension element acting on the frame.

13. The method of claim 10, wherein forming the frame comprises injecting a polymer into a mold.

14. The method of claim 10, wherein forming the frame comprises extruding a polymer through a mold.

15. The method of claim 10, wherein attaching the tension element to the frame comprises bonding, wherein the bonding is one selected from a group consisting of heat staking, ultrasonic welding, and thermal bonding.

16. A system comprising:
a composite frame comprising;
a plurality of openings;
a upstream surface; and
a downstream surface;
a deblinding kit;
a filter element disposed on the upstream surface of the composite frame; and
a tension element disposed on the downstream surface of the composite frame,
wherein the filter element and the tension element are disposed on opposite surfaces of the composite frame, further wherein the filter element and the tension element are configured to increase the rigidity of the composite frame.

17. The method of claim 10, wherein the attaching the tension element to the frame comprises mechanical fastening.

18. The system of claim 16, wherein the tension element is bonded to a downstream surface of the composite frame.

19. The system of claim 16, wherein the deblinding kit comprises a set of balls located within the plurality openings of the composite frame and between the filter element and tension element, wherein the balls are configured to reduce the blinding of the plurality of openings.

* * * * *